US011684176B2

(12) United States Patent
Liao et al.

(10) Patent No.: US 11,684,176 B2
(45) Date of Patent: Jun. 27, 2023

(54) NURSING SLING PILLOW

(71) Applicant: Ennovate Products, LLC, Irvine, CA (US)

(72) Inventors: Chi-Pao Liao, Irvine, CA (US); Jiwon Yang, Costa Mesa, CA (US)

(73) Assignee: ENNOVATE PRODUCTS LLC, Irvine, CA (US)

( * ) Notice: Subject to any disclaimer, the term of this patent is extended or adjusted under 35 U.S.C. 154(b) by 0 days.

(21) Appl. No.: 16/770,525

(22) PCT Filed: Dec. 6, 2018

(86) PCT No.: PCT/US2018/064358
§ 371 (c)(1),
(2) Date: Jun. 5, 2020

(87) PCT Pub. No.: WO2019/113392
PCT Pub. Date: Jun. 13, 2019

(65) Prior Publication Data

US 2021/0161308 A1 Jun. 3, 2021

Related U.S. Application Data

(60) Provisional application No. 62/595,549, filed on Dec. 6, 2017.

(51) Int. Cl.
*A47D 13/02* (2006.01)
*A47D 13/08* (2006.01)

(52) U.S. Cl.
CPC ..... *A47D 13/083* (2013.01); *A47D 13/02* (2013.01)

(58) Field of Classification Search
CPC ..... A47D 13/025; A47D 13/083; A47D 13/02
See application file for complete search history.

(56) References Cited

U.S. PATENT DOCUMENTS

| | | | | |
|---|---|---|---|---|
| 4,757,925 | A * | 7/1988 | Knittel | A47D 13/02 224/158 |
| 4,815,639 | A * | 3/1989 | Lehman | A47D 13/025 224/159 |
| 5,950,887 | A | 9/1999 | Powell | |
| 6,065,655 | A | 5/2000 | Parewick | |
| 6,213,362 | B1 * | 4/2001 | Lorenzini | A47D 13/02 224/158 |
| 6,398,088 | B1 | 6/2002 | Burke | |
| 8,523,028 | B1 * | 9/2013 | Young | A61F 5/026 224/160 |
| 2004/0149790 | A1 * | 8/2004 | Kassai | A47D 13/025 224/160 |
| 2005/0235425 | A1 | 10/2005 | Parrilla | |
| 2006/0138826 | A1 * | 6/2006 | Caton | A47D 13/02 297/256.16 |

(Continued)

FOREIGN PATENT DOCUMENTS

WO 2015/127514 9/2015

OTHER PUBLICATIONS

International Patent App. No. PCT/US2018/064358, Search Report and Written Opinion dated Mar. 7, 2019.

*Primary Examiner* — Robert G Santos
*Assistant Examiner* — Ifeolu A Adeboyejo
(74) *Attorney, Agent, or Firm* — Loza & Loza, LLP; Michael Fedrick

(57) ABSTRACT

A sling which incorporates a cushion for supporting an infant during feeding.

12 Claims, 14 Drawing Sheets

(56) References Cited

U.S. PATENT DOCUMENTS

| | | | | |
|---|---|---|---|---|
| 2006/0265809 | A1 | 11/2006 | Wagner | |
| 2007/0062988 | A1 | 3/2007 | Kassai | |
| 2007/0246492 | A1* | 10/2007 | Carpentieri | A47D 13/02 224/158 |
| 2010/0051658 | A1* | 3/2010 | Parness | A47D 13/02 224/158 |
| 2010/0187268 | A1* | 7/2010 | Rosen | A47D 13/025 224/158 |
| 2011/0119833 | A1 | 5/2011 | Clark | |
| 2011/0226822 | A1* | 9/2011 | Higuchi | A47D 13/025 224/159 |
| 2012/0266350 | A1* | 10/2012 | Zack | A47D 15/00 2/84 |
| 2013/0145556 | A1 | 6/2013 | Kummerfeld | |
| 2014/0076943 | A1* | 3/2014 | Ng | A47D 13/04 224/160 |
| 2016/0235216 | A1* | 8/2016 | Einhorn | A47D 13/08 |

* cited by examiner

NURSING SLING PILLOW

CROSS-REFERENCE TO RELATED APPLICATIONS

This application is the U.S. national stage of International Patent Application No. PCT/US2018/064358, filed on Dec. 6, 2018 and entitled NURSING SLING PILLOW, which claims the benefit of priority under 35 U.S.C. § 119(e) from U.S. Patent Application No. 62/595,549, filed on Dec. 6, 2017. The disclosures of the foregoing applications are incorporated herein by reference in their entirety.

BACKGROUND

Nursing pillows are cushioned devices used or worn by caretakers when feeding or nursing an infant. Such pillows are generally put on the caretaker's lap during feeding to support an infant so that the caretaker can rest his or her hands from time to time. Some nursing pillows wrap around a caretaker's body, but such pillows are large and therefore are not easily portable. Although nursing pillows may support an infant, they don't orient a baby's head toward a caretaker's chest, so the baby needs to be pushed towards the caretaker.

Infant sling-type carriers are devices used to carry an infant from birth up until the infant weighs approximately 30 pounds. Such carrier-type slings are typically fabricated from a flexible fabric and comprise a carrier panel terminating at one or both ends in a tail portion, which serves as a sling tie. The sling is formed by securing the ends of the carrier panel. While sling carriers may generally orient an infant toward the chest of a caretaker, an infant's head and body must be further supported in order for breast feeding to be successful.

Considering the fact that an infant may nurse 10 to 15 times every day for sometimes between 15 and 30 minutes, caretakers are faced with the very real possibility that the act of nursing may result in pain and even injury. Wrist and/or back injuries caused at least in part by nursing may persist for years after a child's infancy, for example. Such injuries are more likely when a pillow is not easily available to support the weight of a nursing infant. The prospect of pain and injury may shorten the time that a child is breast fed by the caretaker, which may be disadvantageous for the child.

SUMMARY

The present nursing sling pillow addresses shortcomings in prior infant sling carriers by incorporating a cushion, both to support an infant during feeding and to relieve pressure on a caretaker. The cushion supports an infant's body, relieving weight from the arms and hands of a caretaker, and also orients the infant toward a caretaker's chest. The nursing sling pillow also addresses shortcomings in prior nursing pillows by incorporating a sling which wraps around an infant to supports the infant in a comfortable, fitted way during feeding.

The present nursing sling pillow 10 generally comprises an elongated cushion 100, which can be curved or longitudinally oriented, and which has a right side 102, a left side 104, a proximal end 126, a distal end 128, an inner surface 130, and an outer surface 140. The cushion includes one or more resilient materials, such as fiber, foam, or aggregate particles, which are retained within a cover 105 formed by one or more panels, in order to provide comfort and protection to an infant user of the sling pillow 10. The distance between the proximal end 126 and distal end 128 of the cushion 100 can between about 40 cm and about 80 cm for example, between about 50 cm and about 70 cm, or about 60 cm.

The nursing sling pillow 10 also includes one or more straps 300, each strap having an outer surface 301, an inner surface 303, a proximal end, and a distal end. The straps 300 are secured to the proximal end 126 and the distal end 128 of the cushion 100. A fastener 200, such as a buckle, is further included to the straps 300 and the cushion 100 together, thereby forming a sling.

In one embodiment, the nursing sling pillow comprises a first strap 330 having a proximal end 332 and distal end 334 and a second strap 350 having a proximal end 352 and a distal end 354. The first strap 330 is attached at the proximal end 332 to the proximal end 126 of the cushion 100, and wherein the second strap 350 is attached at the proximal end 352 to the distal end 128 of the cushion, and wherein the fastener 200 reversibly secures the first strap 330 to the second strap 350.

The cushion 100 can additionally include an arm hole 150 having a right side opening 152, a left side opening 154, and a through-hole extending therebetween in order to allow a user to extend a hand and arm portion therethrough. Alternatively, a loop 60 having a proximal end 66 attached to the strap 300 can be provided to help rest the hand of a caretaker using the nursing sling pillow. In some embodiments, a cover panel 70 can also be attached to the cushion 100 to provide privacy during feeding of an infant.

FIGURES

Figure 1:
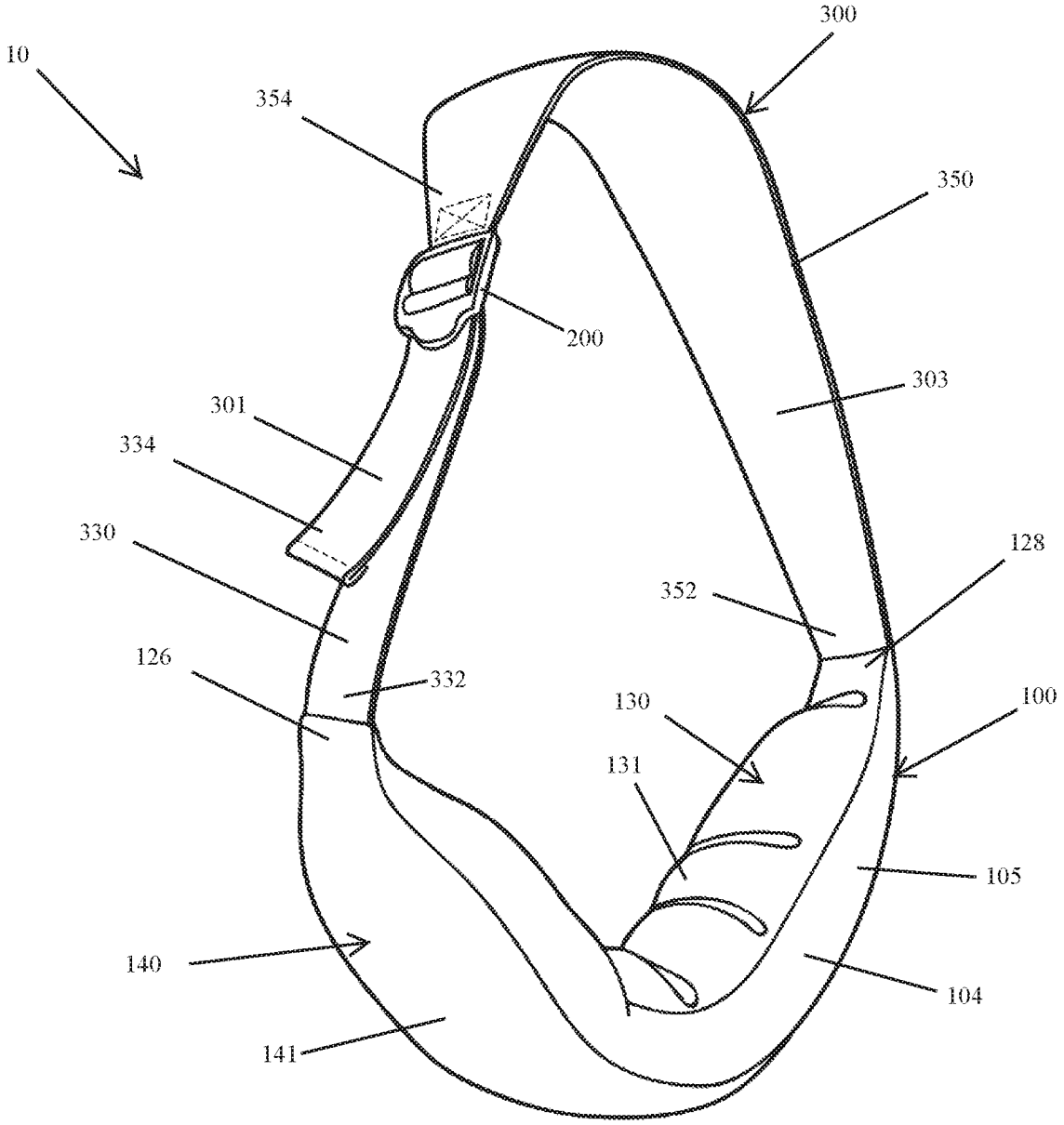
FIG. 1 is a left side perspective view of one embodiment of the present nursing sling pillow.

The reference numbers in the figures designate the following components of the present nursing sling pillow:

| Component | Subcomponent | Reference Number |
|---|---|---|
| Nursing sling pillow | | 10 |
| Adult user, caretaker | | 20 |
| Infant user | | 30 |
| Loop | | 60 |
| | Loop inner surface | 61 |
| | Loop outer surface | 63 |
| | Loop proximal end | 66 |
| Cover | | 70 |
| | Outer surface | 71 |
| | Panel | 75 |
| Cushion portion | | 100 |
| | Right side | 102 |
| | Left side | 104 |
| | Cushion cover | 105 |
| | Seam | 106 |
| | Medial portion | 107 |
| | Side panel | 110 |
| | Proximal end | 126 |
| | Distal end | 128 |
| | Inner surface | 130 |
| | Inner panel | 131 |
| | Outer surface | 140 |
| | Outer panel | 143 |
| Arm hole | | 150 |
| | Right side opening | 152 |
| | Left side opening | 154 |
| | Proximal end | 156 |
| | Distal end | 158 |
| | Inner surface | 151 |
| | First inner surface | 153 |
| | Second inner surface | 155 |
| Fastener | | 200 |
| Straps, strap portion | | 300 |
| | Strap outer surface | 301 |
| | Strap inner surface | 303 |
| | First strap | 330 |
| | First strap proximal end | 332 |
| | First strap distal end | 334 |
| | Second strap | 350 |
| | First strap proximal end | 352 |
| | First strap distal end | 354 |

DESCRIPTION

Definitions

As used herein, the following terms and variations thereof have the meanings given below, unless a different meaning is clearly intended by the context in which such term is used.

"About" refers to a quantity within 10% of the stated quantity or amount.

"Cushion" refers to a flexible structure formed by one or more panels which form a closed receptacle having a space or cavity which holds a filler material therein, in particular a resilient filler material. A cushion can be called a pillow when used to support a head or other body part of a human.

"Fastener" refers to a mechanism for attaching one item or component to another, in particular for attaching two straps together.

"Outer" refers to a location or direction which is on or away from the outer surface of a component of the present nursing sling pillow.

"Panel" refers to a section or piece of material extending over or covering a predetermined area. Panels are generally flat, i.e. are relatively thin as compared to the extent of their length or width, and can be curved or planar. Materials used to form the panels used in the present disclosure are flexible, such as fabric.

"Resilient" refers to a material or component which is reversibly deformable, i.e. it can recoil or spring back into shape after bending, stretching, or being compressed.

"Sling" refers to a length of flexible material, such as a strap or belt, used to form a loop to support or raise a weight (i.e., the weight of an infant).

"Strap" refers to a length of flexible material used to secure one or more components of the present nursing sling pillow. Preferably, straps are relatively flat and have a length greater than their width, in the manner of a belt.

The term "user" will refer to an adult human user of the present nursing sling pillow, generally a caretaker of an infant. An infant or other juvenile supported by the present invention will be referred to as such.

The terms "upper," "lower," "top", "bottom, "right," "left," "proximal," "distal," "inner," "outer," and similar terms will be used to designate areas and positions of components or portions of the present nursing sling pillow, but it is to be understood that these terms are relative and are not absolute terms. "Right" and "left" will thus be used to designate opposing lateral sides of components of the nursing sling pillow.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise. Ranges which are described as being "between" two values include the indicated values.

Nursing Sling Pillow

Figure 2:
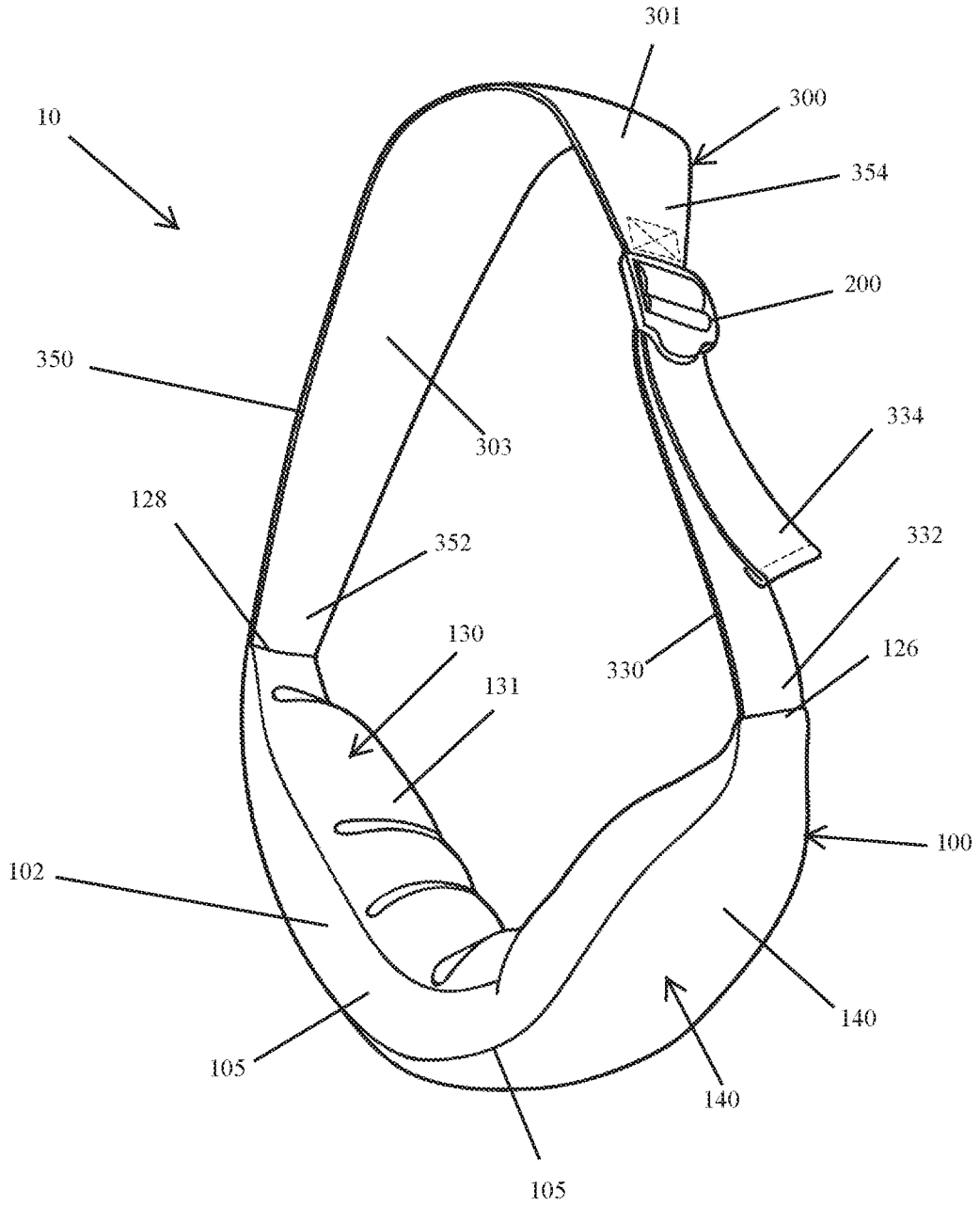
FIG. 2 is a right side perspective view of the nursing sling pillow of FIG. 1.
Figure 3:
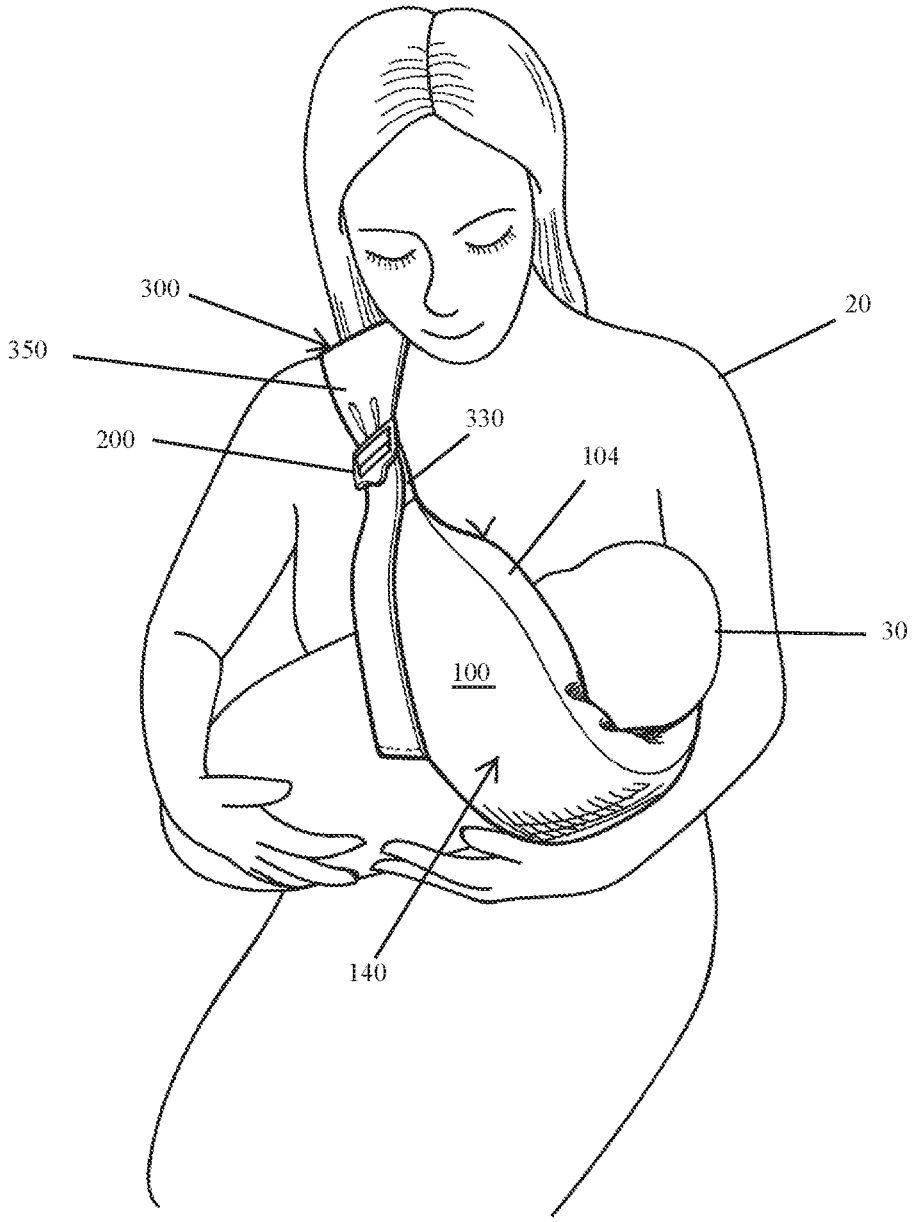
FIG. 3 is a front elevation view of a caretaker using the nursing sling pillow of FIG. 1 to support an infant.

The present nursing sling pillow 10 generally comprises a cushion portion 100 and a strap portion 300. As illustrated in FIGS. 1 and 2, for example, the cushion 100 comprises a right side 102, a left side 104, a proximal end 126, a distal end 128, an inner surface 130, and an outer surface 140. The exterior surfaces of the cushion 100 (including the inner surface 130 and outer surface 140) form a cover 105 which is preferably formed from one or more panels of a flexible material, such as inner panel 131 and outer panel 143, which can contain and encompass a resilient material or materials in the interior of the cushion 100. The inner panel 131 and outer panel 143 can be attached directly to each other to form a cover in ways known to the art, such with a seam 106 made by stitching, or can be indirectly connected by further panels of material, such as side panels 110 covering the right side 102 and left side 104 of the cushion. A single panel or piece material can alternatively contain the resilient material of the cushion.

Figure 13:
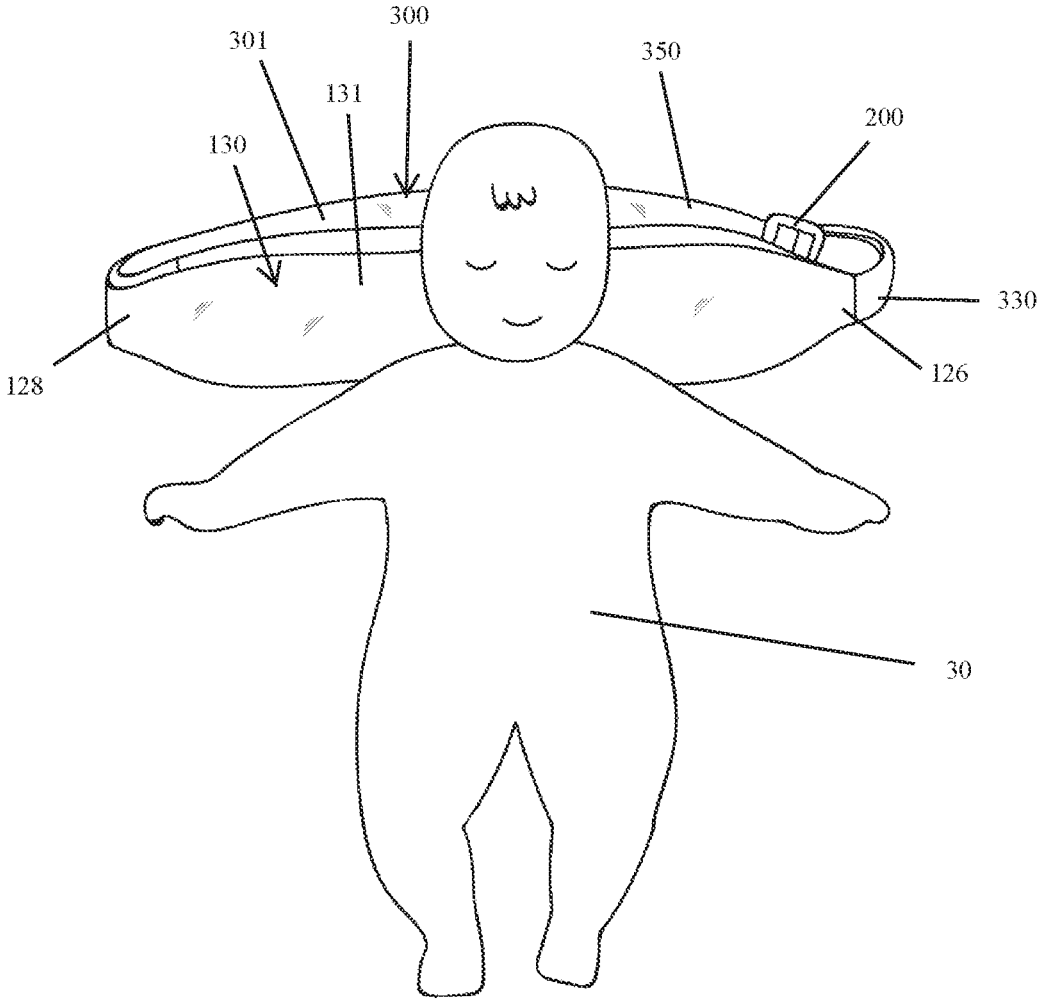
FIG. 13 is an illustration of an infant supported on its back on the nursing sling pillow of FIG. 1.
Figure 14:
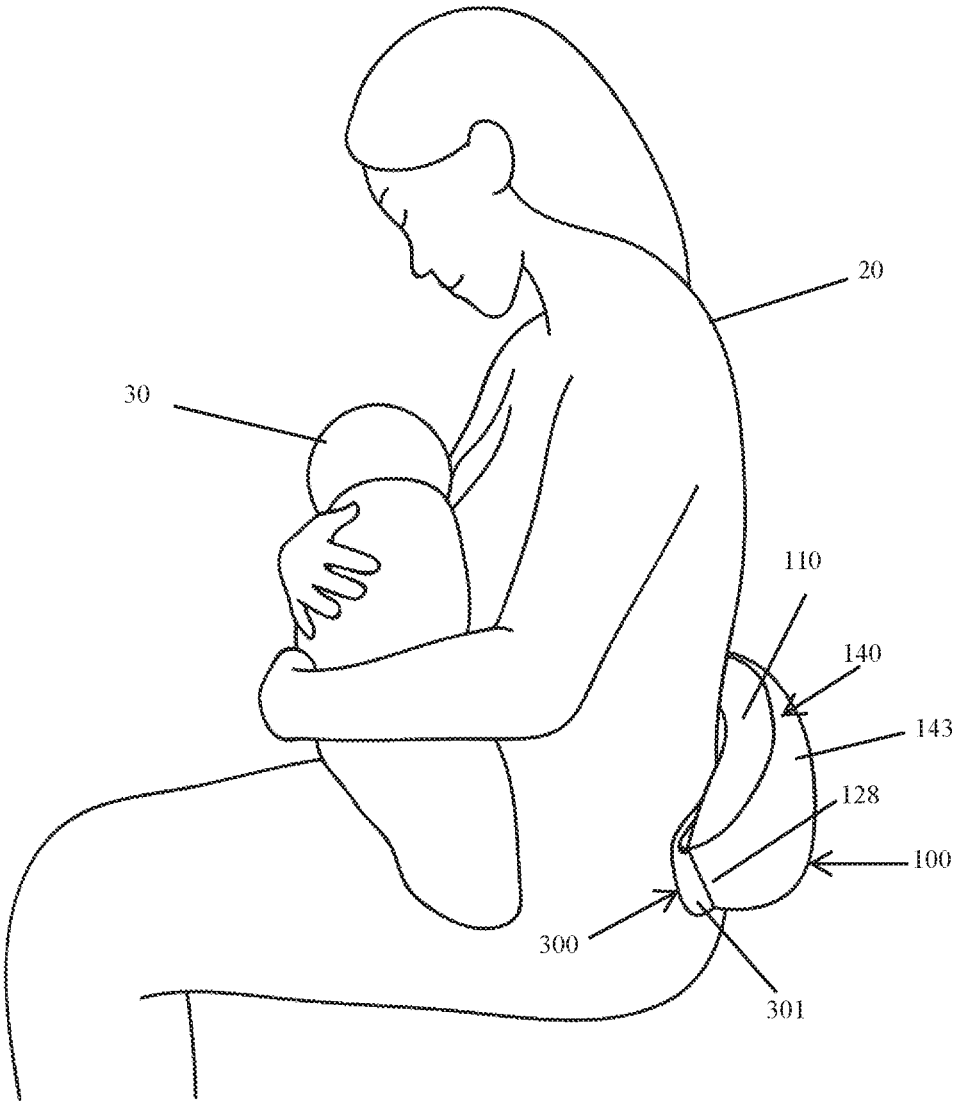
FIG. 14 is a left side elevation view of a caretaker using the nursing sling pillow of FIG. 1 to support the lower back while holding an infant.

The cushion 100 can comprise a continuous body structure which defines a generally elongated shape and/or structure of the cushion 100 and which is configured to comfortably and safely accommodate an infant. The cover 105 of the cushion 100 includes an outer surface 140 facing away from a caretaker when the sling pillow 10 is in use, and an inner surface 130 for contacting an infant which faces toward a caretaker when the sling pillow 10 is in use. The cushion 100 can be fashioned as a curved body structure, as shown in FIG. 1, in which case the length of the inner surface 130 between the proximal end 126 and distal end 128 of the cushion 100 is preferably smaller (less than) than the length of the outer surface 140 between the proximal end 126 and distal end 128 of the cushion 100. The cushion 100 can alternatively assume an uncurved, generally planar configuration when not in use, as shown in FIG. 13, in which case the lengths of the inner surface 130 and outer surface 140 between the proximal end 126 and distal end 128 of the cushion 100 are about the same. In some embodiments, curvilinear shapes such as "C" and "U" shapes can be formed in the cushion in order to better support a caretaker's back when the cushion 100 is positioned to support the caretaker's back, for example as shown in FIG. 14.

The cushion portion 100 comprises a flexible structure made from one or more flexible panels and one or more resilient materials which are reversibly deformable by the weight of an infant, such as a weights of between 6 and 30 pounds. Material forming the cushion should be dense enough to comfortably support the body weight of an infant, but flexible and elastic enough to conform to the body shape of an infant. The cushion portion 100 can comprise a single piece of an appropriate material, such as a piece of memory foam, or can comprise beads, feathers, or other combinations of materials which provide appropriate support, deformability and cushioning. A variety of materials known to the art can be used as the resilient material, such as cotton or polyester fiber, foam rubber, particles of polyester or other aggregate materials, silicone or polyurethane gel, latex, or feathers. Preferably the material is non-allergenic, and is also preferably washable. The cushions can be elastically deformable, such as through the use of an elastically deformable filler material as polyurethane foam (memory foam) or other polymer foam material.

The present sling pillow 10 further includes a strap portion. The strap 300 comprises a length of flexible material capable of supporting the weight of an infant user 10 of the nursing sling pillow 10. The strap portion connects the proximal end 126 and distal end 128 of the cushion 100 using one or more straps 300 extending between the proximal end 126 and distal end 128 of the cushion 100. Each strap comprises an outer surface 301 and an inner surface 303. In the illustrated embodiments, the proximal end 126 and distal end 128 of the cushion 100 are joined through the use of a pair of straps, a first strap 330 and second strap 350. The first strap 330 has a proximal end 332 attached to the proximal end 126 of the cushion in a non-reversible fashion, i.e. such that it cannot be removed without damaging or destroying the attachment means, and also has a distal end 334. The second strap 350 has a proximal end 352 attached to the distal end of the cushion 100, also in a non-reversible manner, and a distal end 354. The distal end 334 of the first strap 330 and the distal end 354 of the second strap 350 are attached to each other in ways known to the art, such as through a fastener 200, preferably in a reversible manner. The fastener 200 preferably allows the distance between the proximal end 332 of the first strap 330 and the proximal end 352 of the distal strap to be adjusted, such as through a loop mechanism as shown in the illustrated embodiments, in order to be able to change the circumference of the nursing sling pillow 10 to accommodate adult users (caretakers) 20 and infant users 30 of different sizes. Alternatively, the strap portion 300 can comprise a piece of flexible material secured to each longitudinal end of the cushion 100 in order to allow it to stretch over a caretaker when being put on.

The fastener 200 preferably allows for reversibly securing the first strap 330 to the second strap 350, so that the two strap portions can be separated. A variety of fasteners known to the art can be used in the present nursing sling pillow 10. For example, a clasp, latch, button, hook-and-eye, tie or hook-and-loop closure (such as Velcro) can be used. In one embodiment, the fastener is a loop buckle, as shown in the illustrated embodiments. Alternatively, the buckle can be a plastic clip buckle, which typically comprises a male portion having a projection on each lateral end and female portion having an opening for receiving the projections. The projections have a wider, laterally extending shape at their distal ends, and when the male portion is inserted into the receptacle, the distal ends of each of the projections is urged into a respective lateral slot of the female portion, thereby securing the male portion to the female portion. The buckle can then be released by squeezing the lateral sides of the female portion and pulling out the male portion of the buckle.

In other embodiments, a single strap 300 can be used. In these embodiments, a fastener or a mating portion of a fastener are attached directly to the proximal end 126 or distal end 128 of the cushion, and a proximal end of the strap 300 is attached to the other end of the cushion 100. The distal end of the strap 300 is then adapted to be attached to the cushion 100 with the fastener 200.

Figure 4:
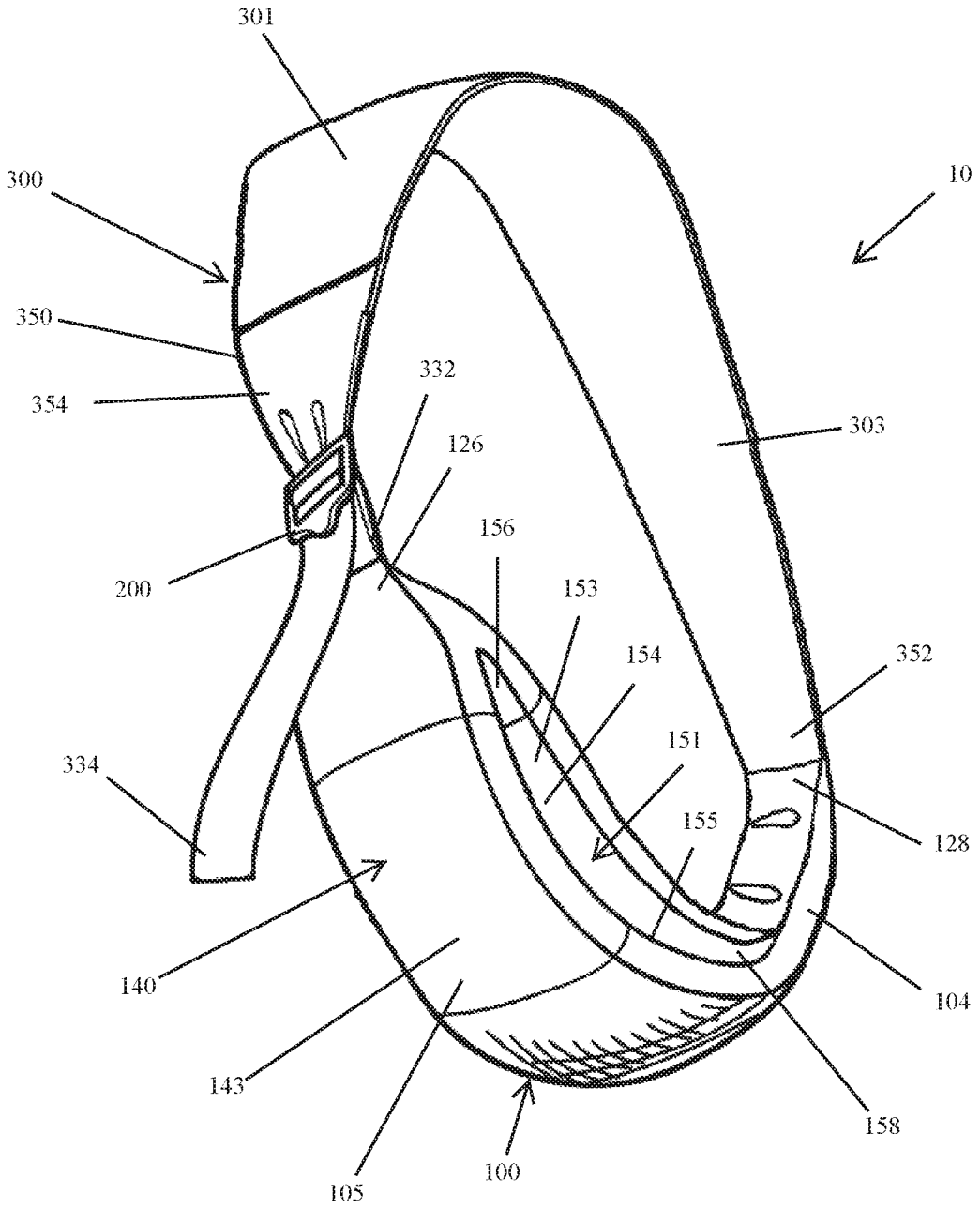
FIG. 4 is a left side perspective view of another embodiment of the present nursing sling pillow.
Figure 5:
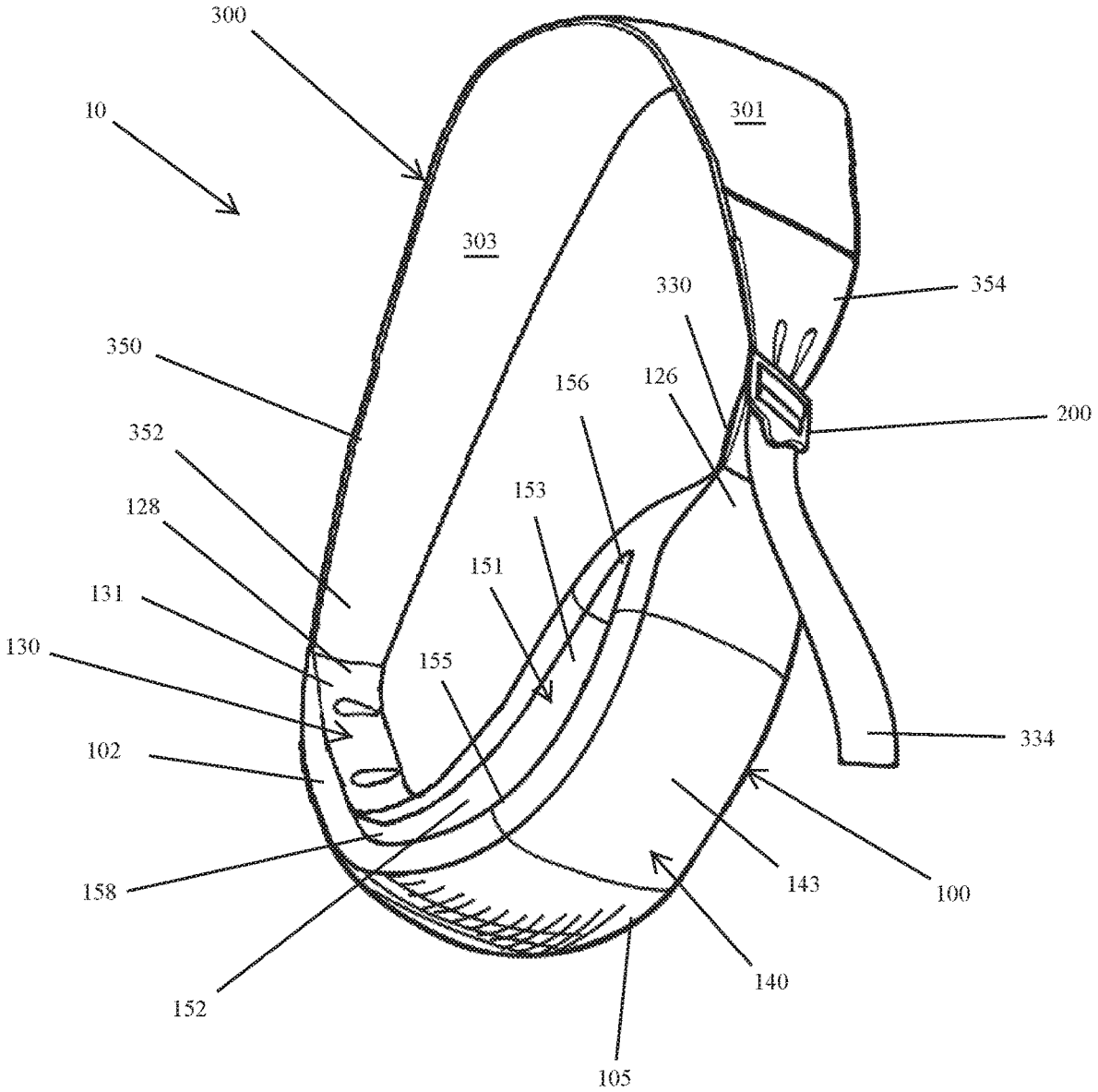
FIG. 5 is a right side perspective view of the nursing sling pillow of FIG. 4.
Figure 6:
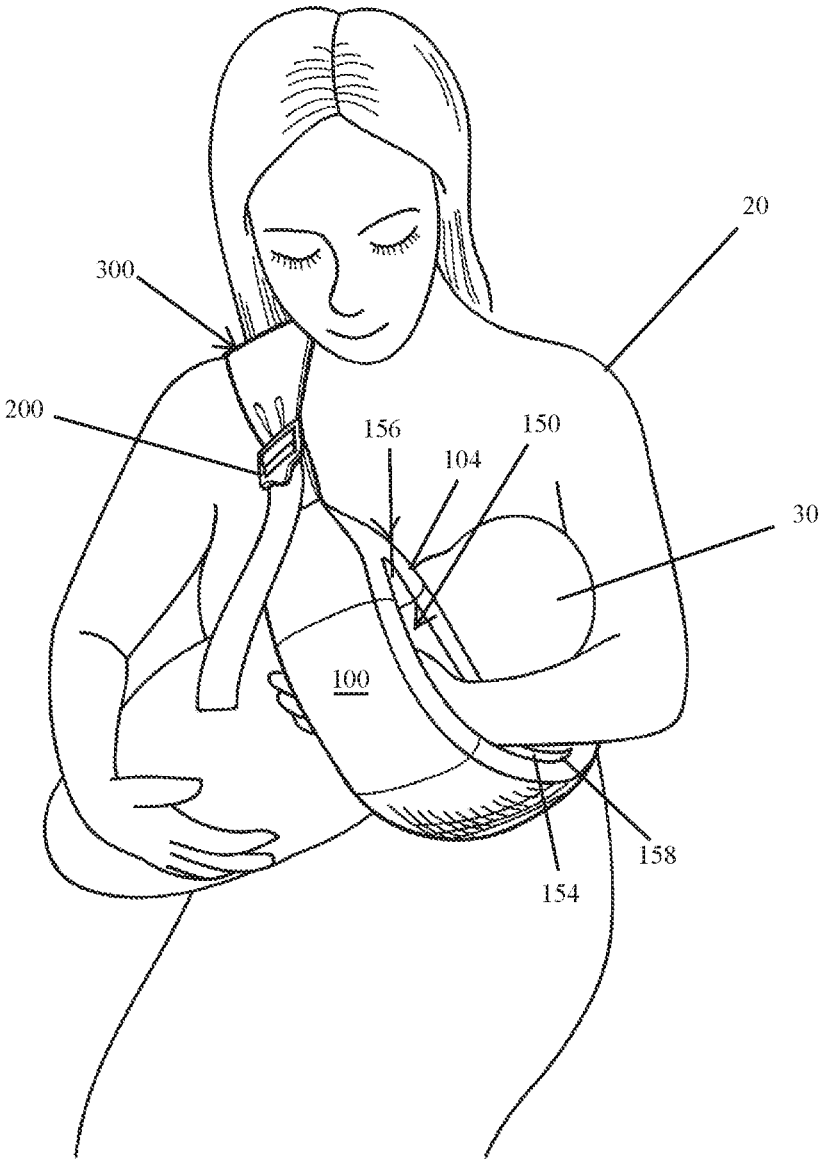
FIG. 6 is a front elevation view of a caretaker using the nursing sling pillow of FIG. 4 to support an infant.
Figure 7:
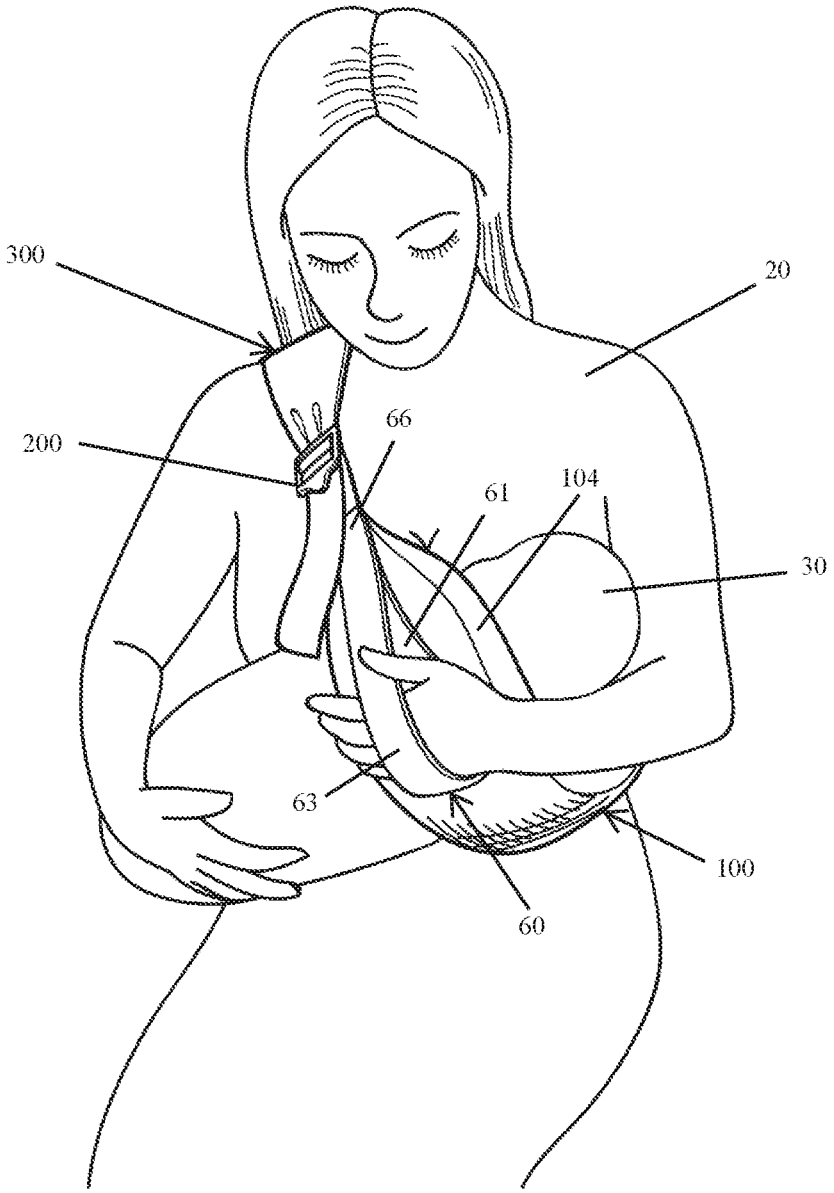
FIG. 7 is a front elevation view of a caretaker using an alternative embodiment of the present nursing sling pillow to support an infant.

In the embodiments of FIGS. 4-6, the cushion 100 additionally includes an arm hole 150 having a proximal end 156, a distal end 158, an arm hole inner surface 151, a right side opening 152, a left side opening 154, and a through-hole extending between the right side opening 152 and left side opening 154. The through-hole can be a gap or hole, but preferably is configured to include a first inner surface 153 and a second inner surface 155 which faces the first inner surface 153. The two inner surfaces of the through-passage preferably are in contact when the sling pillow 10 is not in use. In the embodiment of FIG. 7, a sling or loop of material 60 is provided on or adjacent to the outer surface 140 of the cushion 100. The loop 60 comprises an inner surface 61, outer surface 63, and proximal end 66. The proximal end 66 of the loop 60 is attached to the sling pillow 10, preferably to the strap portion 300. Use of the through-passage 50 and loop 60 can help to prevent or ameliorate conditions such as Quervain's tendonitis, which involves inflammation of the wrist.

Figure 8:
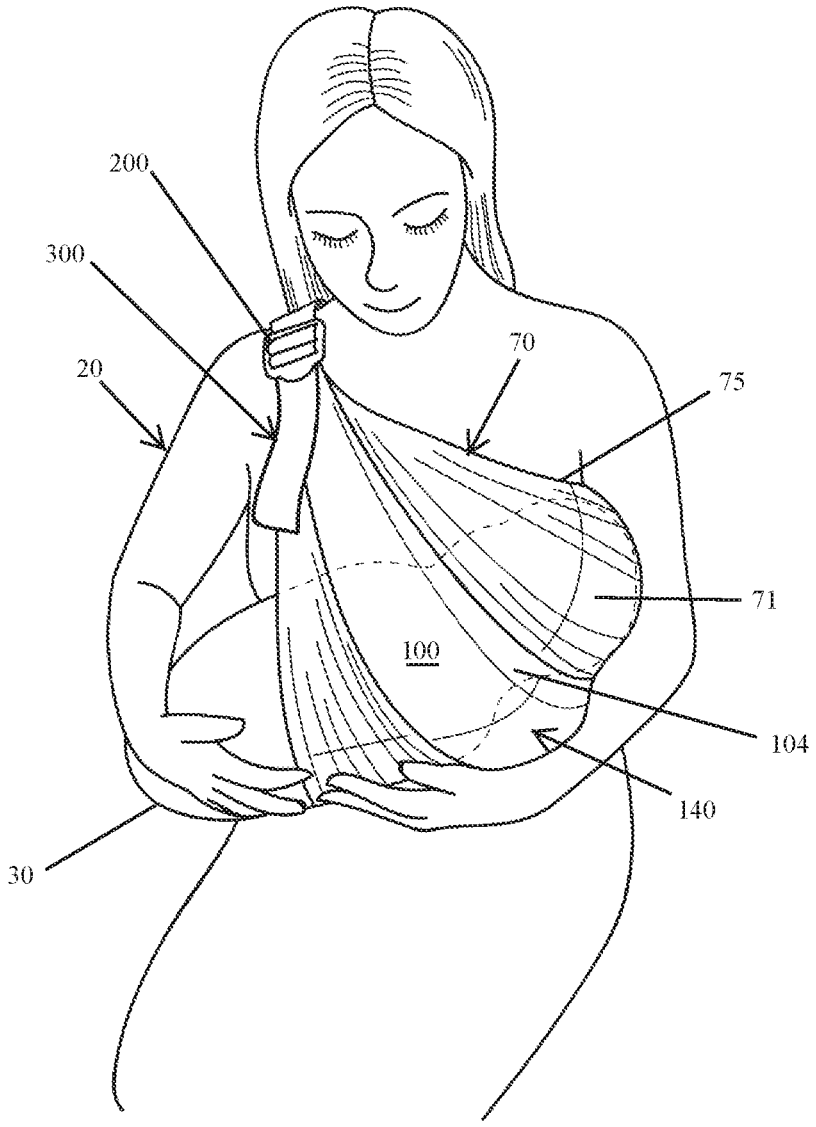
FIG. 8 is a front elevation view of a caretaker using another alternative embodiment of the present nursing sling pillow to support an infant.

The embodiment of FIG. 8 includes a nursing cover 70 for privacy. The cover 70 comprises a panel of material 75 having an outer surface 71 facing outward (toward the public) and an inner surface facing inwardly (toward the caretaker 20) when in use. The cover 70 should be generally wide and long enough to cover a nursing caretaker's chest, in order to provide a desired amount of privacy for nursing, and can preferably be wide enough to extend across a user's shoulders and at least as long as a user's waist. The panel 75 can be made from a variety of flexible, opaque materials, preferably from fabric, and can be attached to the inner surface 130 or outer surface 140 of the cushion.

Figure 9:
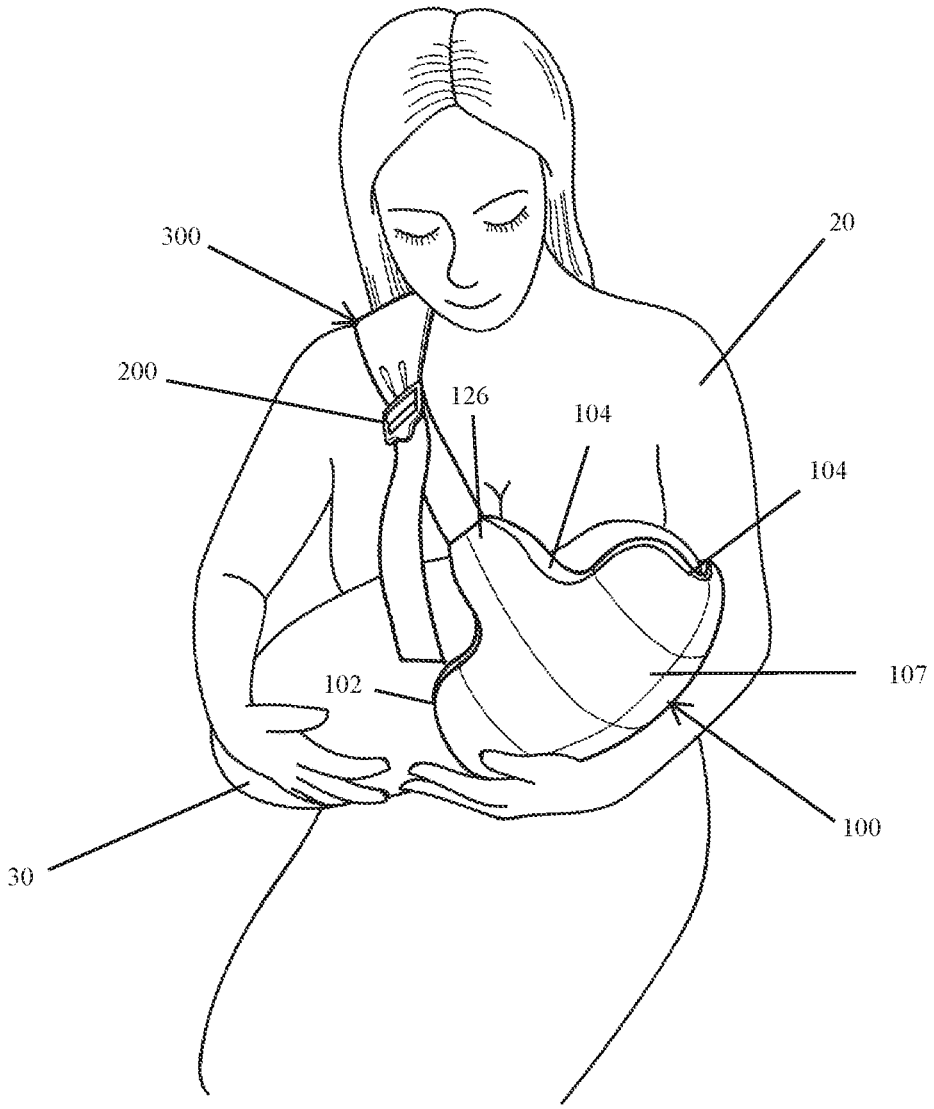
FIG. 9 is a front elevation view of a caretaker using a further embodiment of the present nursing sling pillow to support an infant.
Figure 10:
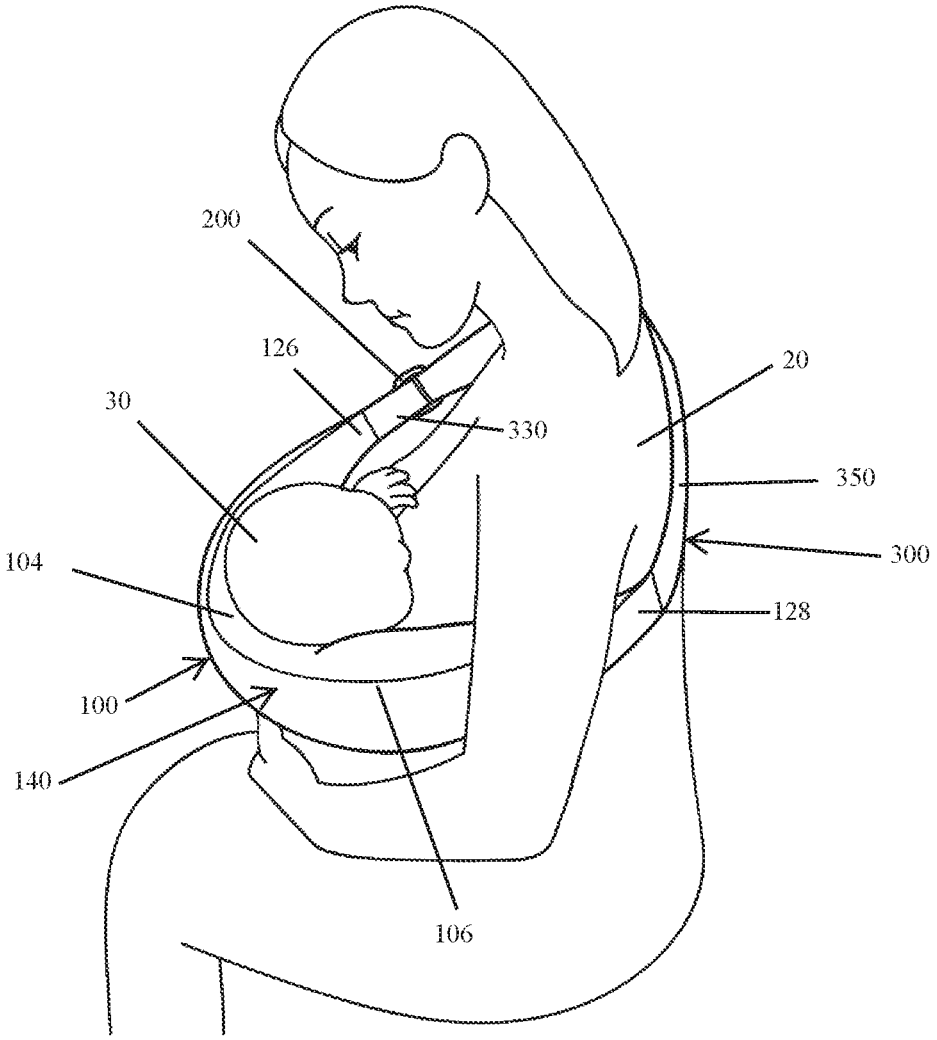
FIG. 10 is a left side perspective view of a caretaker using the nursing sling pillow of FIG. 1 to support an infant.
Figure 11:
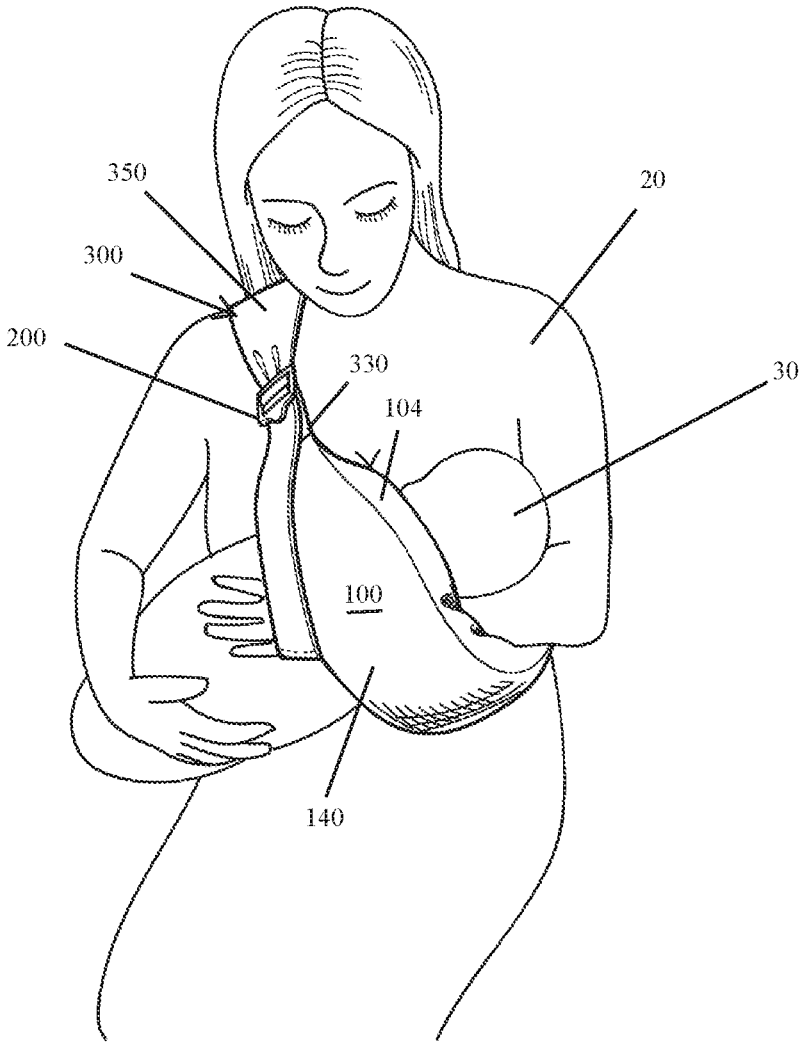
FIG. 11 is a front elevation view of a caretaker using the nursing sling pillow of FIG. 1 to support an infant.
Figure 12:
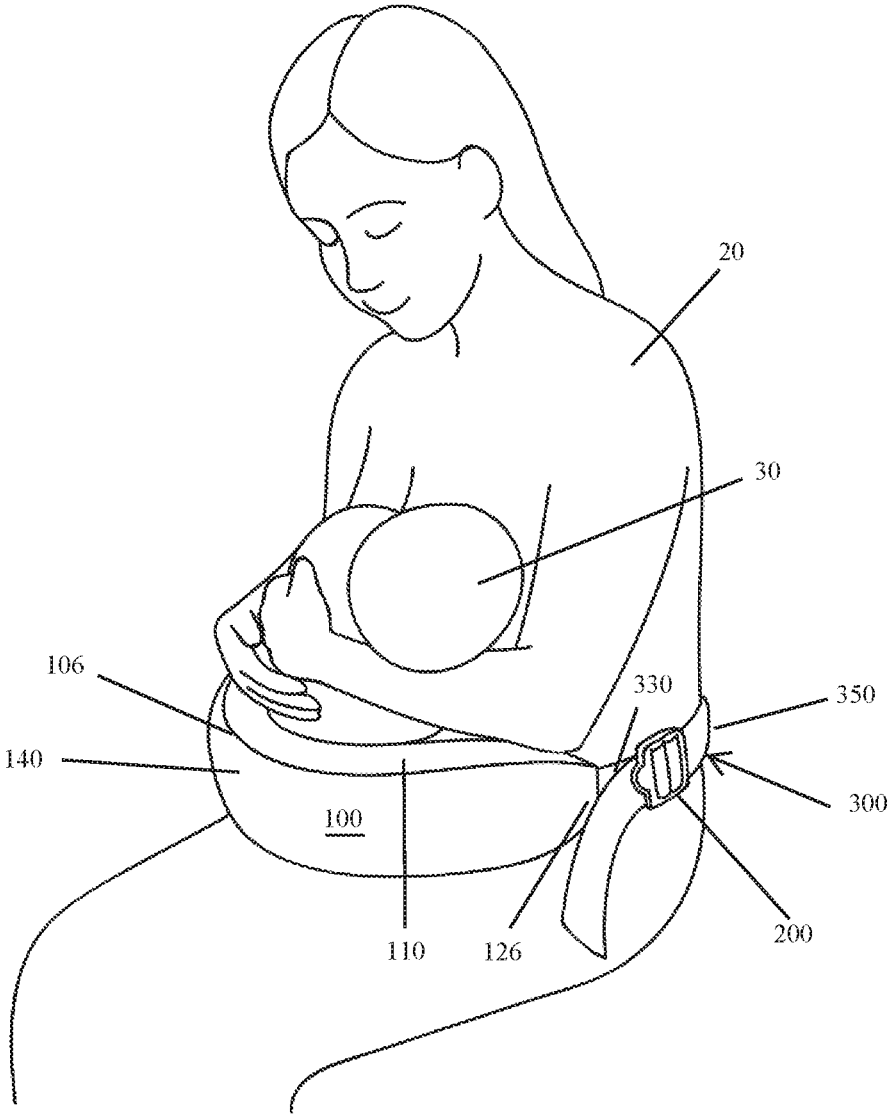
FIG. 12 is a left side perspective view of a caretaker wearing the nursing sling pillow of FIG. 1 around the waist to support an infant.

In another embodiment, shown in FIG. 9, the cushion 100 has an ergonomic shape to support a baby's head, neck and shoulder. In this embodiment, a medial portion 107 of the cushion, i.e. between the proximal end 126 and distal end 128 of the cushion, is wider than the proximal end 126 and distal end 128 of the cushion Methods of Using a Nursing Sling Pillow FIGS. 10-14 illustrate ways of using the present nursing sling pillow 10. The adult user's arm closest to an infant's head can be placed either outside the sling pillow 10 as shown in FIG. 10, when the infant's head and upper torso is securely retained by the cushion 100, or alternatively can be placed in between the cushion 100 and an infant's head and neck as shown in FIG. 11. In another alternative for use when the caretaker 20 is seated, the sling pillow 10 can be worn around a torso of the user, as shown in FIG. 12. The torso of the user may include a chest, an abdomen, a hip, a pelvis, and/or other general body portions of the user associated with the torso. As shown in FIG. 12, the cushion 100 can be placed in the front of the user 20, for example, so that the user's arms and/or an infant can be supported by the cushion 100. In another embodiment, shown in FIG. 14, the sling pillow 10 can be placed against the lower back of the user, to provide back support.

The cushion 100 is preferably sized to accommodate the uses described herein. For example, the distance between the proximal end 126 and distal end 128 of the cushion 100 can be approximately the distance between the hips of a user as shown in FIG. 12, such as between about 40 cm and 80 cm, or about 50 cm to 70 cm, or about 55 cm to 65 cm, or about 60 cm. Alternatively, for other embodiments of the present nursing sling pillow, the cushion 100 can be between about 20 cm and 60 cm, or about 30 and 50 cm, or about 35 and 45 cm.

The present sling pillow 10 is adapted to support an infant while feeding, but it can also be used when an infant is not feeding, to support the infant in a proper resting position. As shown in FIG. 13, the sling pillow 10 can also be placed on a support surface, such as a floor or bassinet, and an infant can be placed on the nursing sling pillow 100. The head of the infant is preferably placed on the outer surface 140 of the cushion 100.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure.

Recitation of value ranges herein is merely intended to serve as a shorthand method for referring individually to each separate value falling within the range. Unless otherwise indicated herein, each individual value is incorporated into the specification as if it were individually recited herein. All references cited herein, including U.S. Patent Application No. 62/595,549, are incorporated by reference in their entirety.

What is claimed is:

1. A nursing sling pillow, comprising:

an elongated cushion (100) having a right side (102), a left side (104), a proximal end (126), a distal end (128), an inner surface (130), and an outer surface (140), wherein the cushion comprises one or more resilient materials retained within a cover (105) formed by one or more panels, and wherein the cushion (100) further comprises an arm hole (150), the arm hole having a right side opening (152), a left side opening (154), and a through-hole extending through the cushion from the left side opening (154) on the left side (104) of the cushion (100) to the right side opening (152) on the right side (102) of the cushion (100) in order to allow a user to extend a hand and arm portion through the cushion;

one or more straps (300), each strap having an outer surface (301), an inner surface (303), a proximal end, and a distal end, wherein the one or more straps (300) are secured to the proximal end (126) and the distal end (128) of the cushion (100); and a fastener (200) for securing the one or more straps (300) and the cushion (100) together, thereby forming a sling.

2. The nursing sling pillow of claim 1, wherein the nursing sling pillow comprises a first strap (330) having a proximal end (332) and distal end (334) and a second strap (350) having a proximal end (352) and a distal end (354).

3. The nursing sling pillow of claim 2, wherein the first strap (330) is attached at the proximal end (332) to the proximal end (126) of the cushion (100), and wherein the second strap (350) is attached at the proximal end (352) to the distal end (128) of the cushion, and wherein the fastener (200) reversibly secures the first strap (330) to the second strap (350).

4. The nursing sling pillow of claim 1, wherein the inner surface (130) is formed by an inner panel (131) and the outer surface (140) is formed by an outer panel (143).

5. The nursing sling pillow of claim 1, wherein the cushion is curved.

6. The nursing sling pillow of claim 1, wherein the resilient materials are fiber, foam, or particles of an aggregate material.

7. The nursing sling pillow of claim 1, wherein the fastener is a buckle.

8. The nursing sling pillow of claim 1, further comprising a loop (60) having a proximal end (66) attached to the strap (300).

9. The nursing sling pillow of claim 1, further comprising a cover panel (70) attached to the cushion (100).

10. The nursing sling pillow of claim 1, wherein the distance between the proximal end (126) and distal end (128) of the cushion (100) is between about 40 cm and about 80 cm.

11. The nursing sling pillow of claim 1, wherein the distance between the proximal end (126) and distal end (128) of the cushion (100) is between about 50 cm and about 70 cm.

12. The nursing sling pillow of claim 1, wherein the distance between the proximal end (126) and distal end (128) of the cushion (100) is about 60 cm.

* * * * *